US006761596B2

(12) United States Patent
Kühbauch et al.

(10) Patent No.: US 6,761,596 B2
(45) Date of Patent: Jul. 13, 2004

(54) CONTACTING MEANS FOR VALVE DRIVES AND A VALVE ARRANGEMENT FITTED WITH IT

(75) Inventors: Heiko Kühbauch, Köngen (DE); Stefan Paech, Esslingen (DE); Achim Ziegele, Uhingen (DE); Ralf Forcht, Wendlingen (DE); Christian Waldeck, Ostfildern (DE)

(73) Assignee: Festo AG & Co., Esslingen (DE)

( * ) Notice: Subject to any disclaimer, the term of this patent is extended or adjusted under 35 U.S.C. 154(b) by 31 days.

(21) Appl. No.: 10/383,921

(22) Filed: Mar. 7, 2003

(65) Prior Publication Data

US 2003/0176084 A1 Sep. 18, 2003

(30) Foreign Application Priority Data

Mar. 16, 2002 (DE) ..... 102 11 798

(51) Int. Cl.[7] ..... H01R 13/24

(52) U.S. Cl. ..... 439/700; 251/129.01

(58) Field of Search ..... 439/700, 34, 55, 439/66, 824; 251/129.01, 129.09, 129.15; 303/119.3, 119.2, 119.1

(56) References Cited

U.S. PATENT DOCUMENTS

| | | | | | |
|---|---|---|---|---|---|
| 3,972,505 | A | * | 8/1976 | Padula | 251/129.15 |
| 4,358,175 | A | * | 11/1982 | Reid | 439/331 |
| 4,842,525 | A | * | 6/1989 | Galloway et al. | 439/34 |
| 5,127,440 | A | * | 7/1992 | Maas et al. | 137/884 |
| 5,137,455 | A | * | 8/1992 | Moerbe et al. | 439/34 |
| 5,348,047 | A | | 9/1994 | Stoll et al. | |
| 5,407,260 | A | * | 4/1995 | Isshiki et al. | 303/119.3 |
| 5,456,621 | A | * | 10/1995 | Gan | 439/700 |
| 5,458,509 | A | * | 10/1995 | Hiraoka et al. | 439/700 |
| 5,482,362 | A | * | 1/1996 | Robinson | 303/119.2 |
| 5,641,315 | A | * | 6/1997 | Swart et al. | 439/824 |
| 5,722,741 | A | * | 3/1998 | Steffes | 303/119.2 |
| 6,033,189 | A | * | 3/2000 | Miura et al. | 417/222.2 |
| 6,155,874 | A | * | 12/2000 | Endo et al. | 439/547 |
| 6,164,160 | A | * | 12/2000 | Nassar | 74/606 R |
| 6,241,489 | B1 | * | 6/2001 | Lewin et al. | 417/410.1 |
| 6,340,320 | B1 | * | 1/2002 | Ogawa | 439/824 |
| 6,364,672 | B1 | * | 4/2002 | Miyazoe et al. | 439/131 |
| 6,433,662 | B1 | * | 8/2002 | Ikoma et al. | 335/256 |
| 6,447,343 | B1 | * | 9/2002 | Zhang et al. | 439/700 |
| 6,464,511 | B1 | * | 10/2002 | Watanabe et al. | 439/66 |
| 6,503,089 | B2 | * | 1/2003 | Saijo et al. | 439/70 |
| 6,616,486 | B2 | * | 9/2003 | Loibl et al. | 439/660 |
| 2002/0127910 | A1 | | 9/2002 | Lolbi et al. | |

FOREIGN PATENT DOCUMENTS

| | | |
|---|---|---|
| DE | 39 10913 A1 | 10/1990 |
| DE | 42 22 637 C2 | 1/1994 |
| DE | 42 22 637 A1 | 1/1994 |
| DE | 295 19 141 U1 | 9/1996 |
| DE | 196 06 184 A1 | 7/1997 |
| DE | 199 46 438 C1 | 5/2001 |
| FR | 2 775 373 | 8/1999 |

* cited by examiner

*Primary Examiner*—Ross Gushi
(74) *Attorney, Agent, or Firm*—Hoffmann & Baron, LLP

(57) ABSTRACT

A contacting means for making electrical contact between a valve drive and a printed circuit board. It comprises a support housing having through ducts in which axially resiliently elastic contacting units are arranged. The contacting units are at one end acted upon by a first contact element of the valve drive and at the other end by a second contact element of the printed circuit board and accordingly rest on such components with a biasing action. Furthermore, a valve arrangement with such a contacting means is provided.

17 Claims, 1 Drawing Sheet

CONTACTING MEANS FOR VALVE DRIVES AND A VALVE ARRANGEMENT FITTED WITH IT

BACKGROUND OF THE INVENTION

The invention relates to a means for production of electrical contacts for electrically joining at least one electrical valve drive to a printed circuit board, comprising first contact elements for the production of electrical connections between a connection part of the valve drive and second contact elements arranged on the printed circuit board. Furthermore, the invention relates to a valve arrangement having at least one valve which is provided with at least one electrical valve drive which is electrically connected by means of first contact elements provided on a connection part with second contact elements provided on a printed circuit board.

THE PRIOR ART

The German patent publication 4,222,637 C2 discloses a valve arrangement, in the case of which a plurality of valves are mounted on a fluid manifold and are fitted respectively with one or more electrical valve drives. For the operation of the valves the valve drives are driven by actuating signals, which are supplied by way of a printed circuit board. In order to produce an electrical contact between the valve drives and the printed circuit board L-shaped connection parts are provided electrically connected with the valve drives, such connection parts being provided with pin-like contact elements fitting into sleeve-like contact elements on the printed circuit board.

A similar arrangement is disclosed in the German patent publication 3,910,913 A1. This differs from the arrangement of the said German patent publication 4,222,637 C2 as regards electrically contacting the valve drives, essentially, merely in as far as the connection part bearing the pin-like contact elements is not designed separately but as an integral component of the valve drive.

The contact producing means employed in known valve arrangements are extremely reliable and in the case of average valve dimensions are able to be produced without substantial tolerance problems. However, such a contact making technology meets its limits in the case of valve arrangements or valve drives with small and miniature dimensions. If at all in this case it is only possible to produce an exactly fitting electrical connection between the contact elements of the valve drives and the contact elements of the printed circuit board if an extremely exacting manufacturing process is employed.

SHORT SUMMARY OF THE INVENTION

One object of the invention is to produce a contacting means and a valve arrangement of the type initially mentioned, which renders possible a precise and reliable contact on the valve drives in the case of small and miniature dimensions involving only a fair amount of manufacturing complexity.

In order to achieve these and/or other objects appearing from the present specification, claims and drawings, in the present invention in the case of a contacting means of the type initially mentioned there is a support housing to be arranged between the connection part and the printed circuit board, such housing having a contacting unit, which is arranged for the respective electrical connection to be produced in a through duct, and is resiliently elastic in the longitudinal direction of the duct, such contacting unit being adapted, when the valve drive is contacted, to be acted on at one end by a contact face of a first contact element and at the other end by a contact face of a second contact element of the printed circuit board, and owing to the resulting compression to touch the two contact faces with a resilient spring bias.

Furthermore, the object of the invention is to be attained in the case of valve arrangement of the type initially mentioned by a contacting unit, which comprises a support housing arranged between the connection part and the printed circuit board, such housing having, for the respective electrical connection to be produced, a contacting unit arranged in a through duct and being resiliently elastic in the longitudinal direction of the duct, such contacting unit being acted upon at one end by a contact face of a first contact element of the connection part and at the other end by a contact face of a second contact element of the printed circuit board, and which owing to compression resulting from being acted upon touches the two contact faces with a resilient bias.

In the case of this contacting technology a support housing is placed between the connection part of the valve drive to be electrically contacted and the printed circuit board, such support housing being provided with through ducts in which the resilient elastic contacting units are located. The contacting units are of such a size that when the valve drive is installed they are compressed between a first contact element of the connection part of the valve drive and a second contact element of the printed circuit board and owing to the resulting spring bias are braced between the contact faces on each side or end. Accordingly there will be a reliable electrical connection with an automatic compensation of manufacturing inaccuracies. Furthermore, in a very small overall space, the resilient elasticity of the contact units means that a large contact distance between the contact elements may be spanned in an adjustable manner. The deformation of the spring and the spring force may be changed practically to any desired extent and designed in accordance with the particular case of application. Since the direct contact making action does not need any plug connection and a simple touching action is sufficient, not only manufacturing inaccuracies in the longitudinal of the through ducts but also those athwart the longitudinal direction may be compensated. By means of the support housing the contacting means are reliably guided and held in place. The means renders possible use without specially adapted and complex contacting means having to be provided on the valve drives or on the printed circuit board.

The German patent publication 19,706,636 C2 does admittedly disclose valve drives using stamped spring contact elements for making contact with an electronic control simply by touching and without plug means. However this design requires special customized comb-like connecting members, whose manufacture is relatively costly.

Further advantageous developments of the invention are defined in the claims.

As a rule electrical valve drives, as for example solenoid valve drives, possess at least two normally pin-like contact elements. Accordingly in the support housing it is convenient for a corresponding number of through ducts and contacting units to be provided for each valve drive to be contacted.

The contacting means is suitable both for contacting only one valve drive and also for the simultaneous contacting of a plurality of valve drives. It is particularly in the latter case that instead of a single-part support housing a design may be suitable, in the case of which the support housing possesses a plurality of support housing segments.

The support housing may be a component of a hood-like support body, which may accommodate the printed circuit board to be connected. The support housing may in this case constitute the top wall section of the hood-like support body.

It is an advantage for the through duct or ducts of the support housing to have abutment means arranged in them, which prevent, the removal of the contacting units contained therein, at least toward the valve drive side. This means that there is an accommodation of the contacting units without risk of loss, even when the valve drive is not fitted. The insertion of the contacting units in the through ducts is preferably implemented before the installation of the printed circuit board through the openings, which face the printed circuit board, of the through ducts. These openings accordingly constitute assembly openings.

The abutment means may constitute a sealing seat, against the associated contacting unit rests, loaded by spring means, when the valve drive is not contacted. This means that when the valve drive is dismounted no dirt may find its way to the contact area.

In a preferred design the contacting units respectively comprise a compression spring, which at one end may bear against one of the contact faces of the printed circuit board and on which at the other end a contacting body is arranged which is able to be moved in relation to the through duct, which body is adapted for being acted upon by a first contact element of the valve drive to be electrically contacted. The compression spring in this case preferably directly constitutes an electrical conductor, which transmits the electrical signals within the contacting unit. There may be a provision such that the compression spring directly touches the associated contact face of the printed circuit board so that owing to such touching contact the desired electrical contacting action is provided between the contacting unit and the printed circuit board. As an alternative it is however possible to have a merely indirect mechanical contact on the contact face of the printed circuit board, more particularly by the use of a contacting body, placed in front of the compression spring, and similar to that one employed for contacting the contact elements provided on the connection part.

Preferably the arrangement is such that the contacting body, when the valve drive is not installed, is moved into a home position by the compression spring. The compression spring may in this case, but does not necessarily have to, be subject to a biasing resilient force. On fitting the valve drive the contacting body is acted upon by the first contact element and shifted toward the printed circuit board so that the length of the contacting unit is reduced and simultaneously a return force is built up, by which the contacting unit is spring loaded between the contact faces of the two contact elements.

A particularly reliable function may be ensured if the contacting body is spherical in form. This prevents skew positioning on being moved within the associated through duct.

As a compression spring element, as for example a helical spring, or however a plurality of combined spring elements, as for instance a stack of belleville washers, may be utilized.

In order, during operation with a valve arrangement fitted with the contacting means, to avoid ingress of moisture into the contact making area, it is an advantage for the support housing to possess a socket on the valve drive side (facing the at least one valve drive) adjacent to the openings of the through ducts, such socket serving to receive a seal to be placed between the support housing and the connection part.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
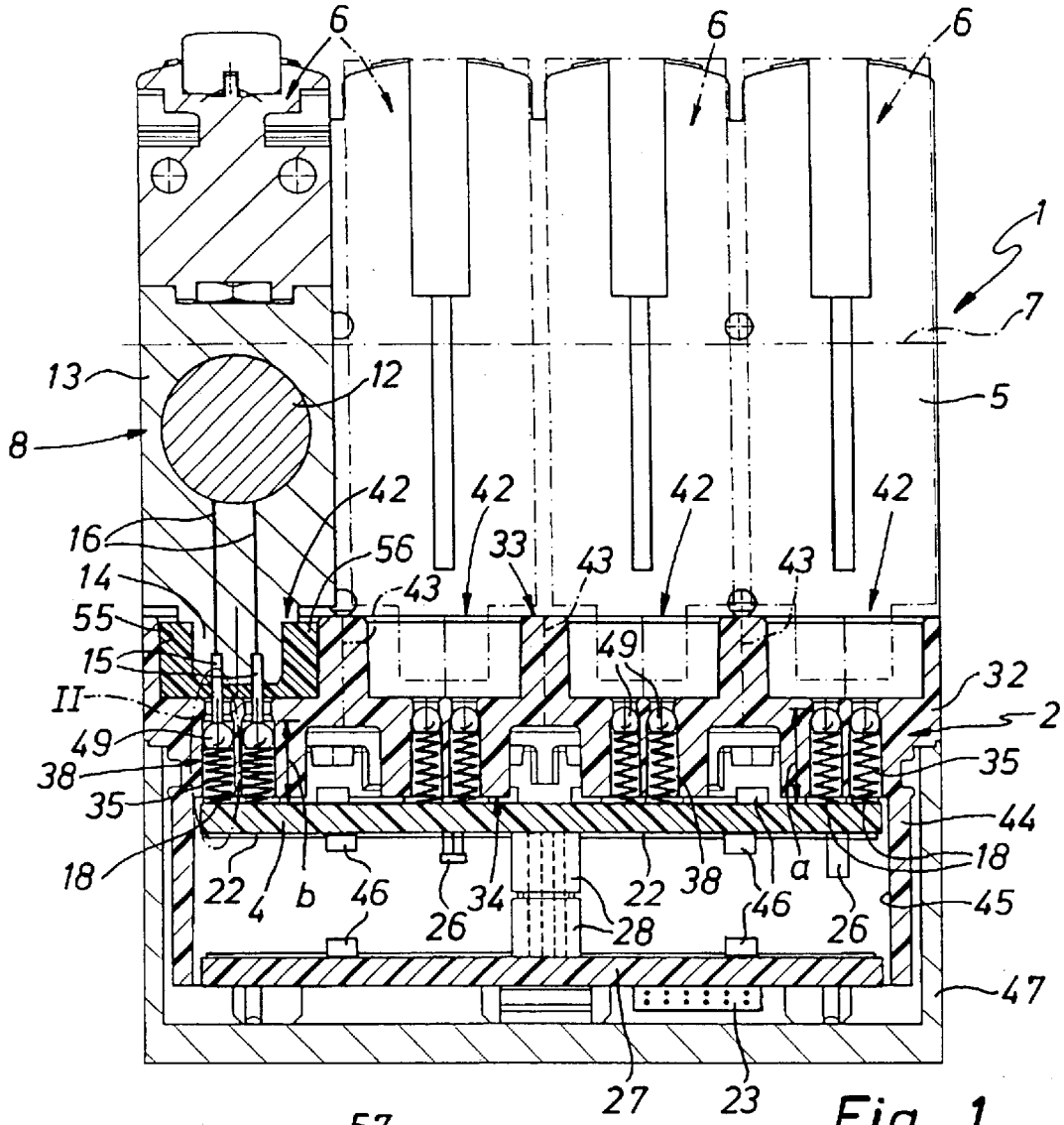
FIG. 1 shows a preferred embodiment of the valve arrangement of the invention, which is provided with a preferred design of the contacting means in accordance with the invention, as seen in cross section.

The drawing shows a valve arrangement, generally referenced 1, having an integrated contacting means 2 for making electrical contact between a plurality of electrical valve drives 8 and a printed circuit board 4. FIG. 1 shows a state, in which the valve arrangement 1 is presently only fitted with one of four possible valve drives 8.

The valve arrangement 1 possesses a valve carrier 5, which is designed to simultaneously hold or receive a plurality of valves 6. The drawing shows a state of the valve arrangement 1, in which same is fitted with only one of the possible valves 6. The other valves 6, which may be installed, are however indicated in chained lines in order to make clear the position assumed in the installed state in addition.

In the condition with the valves 6 mounted on the valve carrier 5 they are juxtaposed in sequence in a row direction 7 indicated in chained line. Their longitudinal axes, which in FIG. 1 are at a right angle to the plane of the drawing, are here aligned to be parallel to one another. It is quite possible for a plurality of rows of valves to be provided with row directions parallel to each other so that in the case of need a matrix-like arrangement may be produced.

Each valve unit 6 possesses a valve unit of conventional design placed underneath the plane of the drawing. The valve unit possesses a housing with an integrated valve member preferably in the form of a valve spool, which is able to be brought into different positions. Dependent on the position of switching of the valve different valve ducts of the valve unit are connected with, or separated from each, other in a predetermined manner for fluid transmission, in order to supply or let off a fluid, more particularly compressed air, to or from a connected load. Such load will be more particularly a fluid operated drive, as for example a linear drive or a rotary drive.

The respective position of the valve member may be set by at least one electrical drive 8 of the respective valve 6. The valve drive 8 may directly work the valve member or may be a component of a pilot valve, which can control a drive fluid, which for its part is able to act on the valve member for the purpose of changing its position.

For the electrical valve drive 8 various different forms of design are possible. It is more particularly recommended to utilize a piezoelectric valve drive or, as in the working example, a solenoid valve drive. In FIG. 1 the solenoid drive unit 12 of the valve drive 8, which as a rule contains at least one electrically excited coil and an armature moved in relation to it, is only indicated diagrammatically. It is accommodated in the valve drive housing 13.

The valve drive 8 is provided with a connection part 14. The latter is in the working example constituted by a part of the valve drive housing 13. It is a question of a form thereof which is more especially an integral component of the valve drive housing 13. However a configuration would be possible. in the case of which the part 14 is designed separately from the valve drive 8 and for example is able to be set in place by means of a plug connection means or some other means on the valve drive 8.

The connection part 14 is provided with two electrically conductive first contact elements 15. It is preferably a question of contact pins. In the working example same have a round cross section, although however a flat and/or rectangular cross section is more especially possible.

The first contact elements 15 are at one end embedded in the material of the connection part 14 and at the other end protrude, with a mutually parallel alignment, from the connection part 14. However they can be also simply set on the connection part or set in it to be flush with the surface. Electrical conductors 16, which run in the interior of the connection part 14 and of the valve drive housing 13, constitute an electrical connection between the first contact elements 15 and the drive unit 12. The term "electrical conductor 16" is also to be taken to mean electronic components, which may be provided for producing or processing the electrical signals.

As seen in the installed condition of a plurality of valves 6, the first contact parts 15 of all valve drives 3 are turned toward the same side. As was the case with the valves 6, the first contact elements 15 of all valve drives 3 are preferably arranged in the row direction 7 in sequence.

In the working embodiment the first contact elements 15 of all valve drives 8 project toward a printed circuit board 4 placed opposite the connection parts 14 with a clearance. On the printed circuit board 4 a number, corresponding to the number of first contact elements 15, of electrically conductive second contact elements 18 is provided. In the installed state of a valve drive 8 its first contact elements 15, provided on the respective connection part 14, are electrically joined with respectively one of the second contact elements 18 on the printed circuit board side. The second contact elements 18 possess a contact face 25 facing the contact faces 24 (of the contact pin 15) facing away from the connection part 14. It is a question more particularly of a flat or planar contact face 25, which extends at a right angle to the longitudinal direction of the first contact elements 15. The second contact elements 18 are more especially constituted by thin contact plates which are formed in an inherently known etching method on the printed circuit board 4.

Electrical conductors 22, which extend on the printed circuit board 4, are electrically connected with the individual second contact elements 18. By way of them the valve drives 8 are supplied with electrical actuating signals necessary for operation. Preferably, the electrical conductors 22 are connected with electronic components 26 provided on the printed circuit board 4 so that such components define the so-called electronic valve circuitry, which effects any desired processing of the electrical actuating signals, as for example a reduction in the hold current or, more particularly in the case of piezoelectric drives, a voltage conversion.

By way of an electromagnetic connection member 23, which is connected with the printed circuit board 4 and, respectively, its electrical conductors 22, it is possible for an electrical connection to be produced with an electronic control device, which provides the actuating signals for the valve drives 8. The connection member 23 can in this case be provided directly on the printed circuit board 4. In the working embodiment a modification is possible since on the side, which is opposite to the valve drives 8, of the printed circuit board 4 a further printed circuit board 27 is installed parallel to and the spaced from it, the connection member 23 being mounted on it, the further printed circuit board 27 being electrically connected by way of an electrical connection means 28—for example a plug connecting means or a flexible printed wiring arrangement. This further printed circuit board 27 can be fitted with electronic components. More particularly a design is possible, in the case of which the further printed circuit board 27 comprises control circuitry for control of the valve drives 8 and/or is fitted with a bus station.

The first contact elements 15 are not directly connected with the second contact elements 18 but rather by the intermediary of the above mentioned contacting means 2 electrically.

The contacting means 2 possesses a support housing 32, which in the case of the embodiment is formed like a plate, which is placed between the connection parts 14 of the valve drives 8 and the printed circuit board 4 having the second contact elements 18. It is preferably manufactured of plastic material.

The side faces of the support housing 32 facing the valve drives 8 or, respectively, their connection parts 14, will be termed the valve drives side 33. The oppositely facing side face, facing the printed circuit board 4, of the support housing 32 will be termed the printed circuit board sides 34 or side.

For the electrical connection to be produced between a respective first contact element 15 and the associated second contact element 18 the support housing 32 is provided with a through duct 35 extending from the valve drive side 33 as far as the printed circuit board side 34. The through duct 35 has a linear extent and at one end is flush with a first contact element 15 and at the other end with a second contact element 18.

In the installed state of a valve drive 8 its pin-like first contact elements 15 respectively extend, preferably coaxially, through the entry opening 36, provided on the valve drive side 33 into the associated through duct 35. This arrangement is to be seen clearly in FIG. 1 in connection with the installed valve 6 illustrated on the left side.

The respectively associated contact face 25 of the second contact element 18 on the printed circuit board side 34 to be contacted is opposite to the opening provide on the printed circuit board side 34. For reasons to be explained later this opening will be termed the assembly opening 37.

Between the contact face 25 and the assembly opening 37 a certain distance may be left.

In each through duct 35 a contacting unit 38 is provided which is resiliently elastic in the longitudinal direction of the duct. It is electrically conductive and when the valve drive 8 is in the installed state, is acted upon at one end by the contact face 24, defined by the end face of the associated first contact element 15 and at the other end by the contact face 25 of the associated contact element 18.

When the valve drive 8 is not installed each respective contacting unit 28 has an initial length a. When the valve drive 3 is installed the length is shortened to an operational length owing to the action from the opposite end sides to an operational length b. This shortening takes place with a compression of the spring means of the contacting unit 38, this meaning that the contacting unit 38 makes firm contact both at the contact face 24 of the first contact element 15 and also on the contact face 25 of the second contact element 18 with a spring biasing action. Accordingly a reliable electrical connection is ensured and the actuating signals may be supplied, without any trouble, from the printed circuit board 4 through the contacting unit 38 by way of the associated first contact element 15 to the drive unit 12.

Such an electrical contact making action takes place in the individual valve drives 8 independently of each other. For each valve drive 8 a contacting zone 42 is provided on the support housing 32, which is provided with the necessary number of through duct 35 and contacting units 38 for contacting the respective valve drive 8. In the working embodiment the through ducts 35 having contacting units 38 are placed in pairs in each contacting zone 42. The number thereof will be dependent in practice on the configuration of the valve drives and the number of first contact elements 15 provided on them.

Preferably the support housing 32 is of integral design. It is however possible to have a division up into individual support housing segments, partition into individual support housing segments being possible, the zone of separation being for example indicated at 43 in chained lines. In this case it is preferred for each support housing segment to be provided with at least one contacting zone 42.

The dimensions of the support housing 32 in the plane of extent running at a right angle to the longitudinal direction of the duct are preferably so selected that the printed circuit board 4 is completely covered over by the support housing 32. Preferably, the support housing 32 is the top wall section of a hood-like support body generally referenced 44, which defines a receiving space 45 which accommodates the printed circuit board 4 and preferably also any further printed circuit board 27 present. Using detent means 46 or other catch means on the support body 44 it is possible for the printed circuit boards 4 and 27 to be secured, more particularly detachably, in the accommodating space 45.

As shown in FIG. 1 the support body 44 may be inserted, with the open side of the accommodating space 45 to the fore, into an external housing 47, for example in the form of a box. In this case it is convenient for the portion constituting the support housing 32, to remain at least partially outside the external housing 47 and for it to more particularly bear against the edge of the outer housing 47. By means of attachment means, not illustrated in detail, a preferably releasable firm connection may be produced between the outer housing 47 and the support body 44.

Departing from the illustrated arrangement it is obviously possible to so design the contacting means 2 that only one or more valve drives of a single valve are able to be brought into contact with a printed circuit board. For instance, the above mentioned support housing segments may be respectively separately utilized.

In the working embodiment the individual contacting units 38 comprise a compression spring 48 able to be compressed in the longitudinal direction and a contacting body 49 on its front side facing the valve drive side 33. The compression spring 48 is a metallic helical spring, which is set in front of the contacting body 49. The contacting body 49 is the preferably in the form of a metallic sphere, which is received in and acted upon by the front end of the compression spring 48.

The insertion of the contacting units 38 in the through ducts 35 is performed while the printed circuit board 4 is not yet installed through the freely accessible assembly openings 37. The depth of insertion is limited by the abutment means 52 in the through ducts 35, against which the contacting body 49 abuts. Preferably, the abutment means 52 are constituted by a step or shoulder in the through duct 35 which results in there being an annular radial projection 53 locally reducing the cross section of the through duct 35, against which the contacting body 49 may bear axially in the interior.

Preferably, the radial projection 53 is located adjacent to the entry opening 36. In the working embodiment it directly defines this entry opening 36. The latter accordingly possesses a smaller diameter than the assembly opening 37.

Owing to the abutment means 52 removal of the contacting unit 38 toward the valve drive side 33 is prevented. Even when the valve drive 8 is not installed the contacting unit 38 is reliably retained in the through duct 35 so that it cannot be lost.

Figure 2:
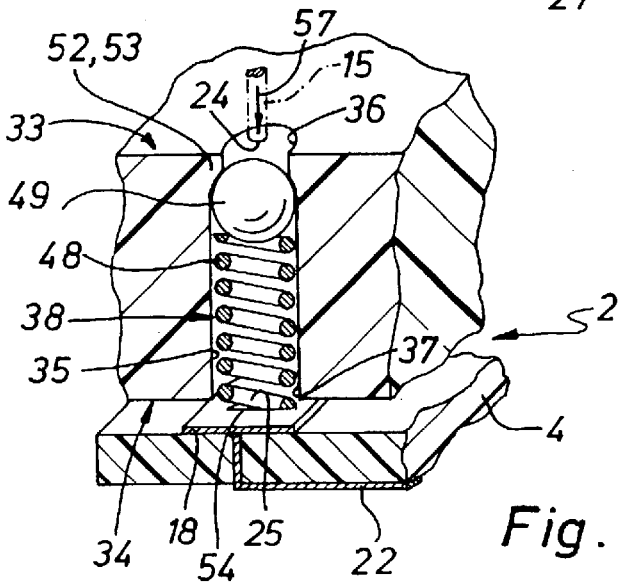
FIG. 2 shows a section II, on a larger scale, taken through the structure of FIG. 1 in one of the contact making areas.

During the assembly of the arrangement the printed circuit board 4 is preferably installed following the insertion of the contacting units 38. When it is installed its contact faces 25, which are placed on it with the right alignment, thrust against the rear ends of the compression springs 48. The latter are then subjected to an initial pre-compression, this meaning that the contacting body 49 is subject to a certain degree of bias acting against the radial projection 53. Accordingly it is possible for the radial projection 53 to form s sealing seat, which cooperates with the contacting body 49 in a sealing manner so that when the valve drive 8 is not installed entry of dirt into the through duct 35 is prevented or at least made less likely. FIG. 2 shows such a sealed state.

During the installation of a valve 6 the first contact elements 15 pass as indicated by the arrow 57 (FIG. 2) through the entry opening 36 into the through duct 35. After moving a small distance their end face functioning as a contact face engages the facing front side or end of the respectively associated contacting body 49 and thrust same away from the abutment means 52. Since the compression spring 48 bears against the contact face 25 of the second-contact element 18, there is a further compression and an increase in the spring bias force. This ensures the desired pressing force acting between the contacting unit 38 and the two contact elements 15 and 18.

The electrical connection between the contacting unit 38 and the second contact element 18 is in this case produced by the touching contact between the rear end section 54 of the compression spring 48 and the contact face 25. No additional contacting body is provided so that an extremely economic unit is produced as a result. However, in case of need an additional contacting body may be provided between the rear end section 54 and the contact face 25.

In the contacted state the electrical signals are passed from the contact face 25 by way of the compression spring 48, functioning as an electrical conductor, and the contacting body 49, also functioning as an electrical conductor, to the first contact element 15.

Owing to the spherical configuration of the contacting body 49 an optimum kinetic behavior is ensured within the through duct 35. Even when the first contact element 15 does not centrally engage the contacting body 49, skew positioning is prevented. The contacting body 49 is preferably guided within the through duct 35 at the periphery—the same preferably applies for the compression spring 48 as well—so that movement preventing engagement is out of the question.

Owing to the axial resilient elasticity of the contacting unit 38 manufacturing inaccuracies may be compensated for without any trouble. Irregular clearances between the two contact elements 15 and 18 are spanned without interruption of the electrical connection.

Starting at the entry opening 36 the through duct 35 has a larger cross section than the first contact element 15. This means that during fitting of the valve drive 8 irregular positioning of the first contact element 15 in the plane of extent of the printed circuit board 4 can be tolerated without any trouble. Compensation of inaccuracies in this plane is facilitated furthermore by the absence of a permanent connection between the contacting unit 38 and the second contact element 18.

The compression spring 48 may comprise a plurality of spring components assembled together, as for instance of a stack of belleville washers. It is possible for the contacting body 49 and the compression spring 48 to be firmly connected together or even for them to be made integrally. Even a design made of plastic is possible, if using surface mounted or integrated electrical conductors the desired electrical connection is ensured between the two axial end sides.

In the working embodiment there is a provision such that the first contact elements 15 extend into the through duct 35 when they make contact. However a design is also possible, in the case of the contacting body 49 extends at least partially through the entry opening 36 at least in the home position and preferably when the valve drive is installed, such protruding part of the contacting body 19 being for instance one with a semi-spherical shape or some other shape. It can then be contacted by the first contact element 15 without same necessarily extending into the through duct 35. Therefore it is possible for the first contact element 15, as already mentioned, basically to have a flat form.

It is furthermore not absolutely necessary for the contacting unit 38, when in the starting position and without the valve drive 8 installed, to be seated in the through duct subject to an axial spring bias action. More especially when the above mentioned sealing action is not wanted, the contacting unit 38 may in this starting position be received in the through duct 35 with an at least slight axial play. In this case it is even possible to do without the abutment means 52, if by having a suitable alignment of the valve drive it is possible to ensure that the contacting units 38 cannot fall out through the entry opening 36 when the valve drives 8 are removed.

In the working embodiment the support housing 32 is adjacent to a respective contact area 42 on the valve drive side 33 furthermore provided with a recess, on the floor of which the entry openings 36 are located and which constitutes a socket 55 for a seal 56. This seal 56 reliably seals off the transitional zone between the connection part 14 and the support housing 32 when the valve drive 8 is installed and prevents entry of dirt or moisture in the parts adjacent to the contact pins 15 and the entry openings 36. The seal 56 preferably possesses through openings for the contact pins 15 to extend through.

The contacting means 2 may be manufactured with economically with different dimensions for a great variety of types of valve. Simply owing to a variation in the length or stiffness of the compression springs adaptation to different circumstances may be ensured. One and the same support housing may if necessary be fitted alternatively or at the same time with contacting units 38, which differ as regards their spring characteristics.

What is claimed is:

1. A means for production of electrical contacts for electrically joining at least one electrical valve drive to a printed circuit board, entailing producing electrical connections between first contact elements arranged on a connection part of the valve drive and second contact elements arranged on the printed circuit board, and furthermore comprising a support housing to be arranged between the connection part and the printed circuit board, such housing having a contacting unit, which is arranged for the respective electrical connection to be produced in a through duct, and being resiliently elastic in the longitudinal direction of the duct, such contacting unit being adapted, when the valve drive is contacted, to be acted on at one end by a contact face of a first contact element and at the other end by a contact face of a second contact element of the printed circuit board, and owing to the resulting compression to touch the two contact faces with a resilient spring bias.

2. The contacting means as set forth in claim 1, wherein the support housing comprises for each valve drive to be electrically contacted at least two through ducts respectively fitted with a contacting unit.

3. The contacting means as set forth in claim 1, wherein the support housing possesses an extent such that it completely covers over the associated printed circuit board.

4. The contacting means as set forth in claim 1, wherein the support housing is a component of a hood-like support body, which is designed to accommodate the printed circuit board.

5. The contacting means as set forth in claim 1, wherein the support housing on the valve drive side facing the at least one valve drive adjacent to the openings of the through ducts associated with a valve drive to be contacted possesses a socket for a seal effective between the support housing and the connection part.

6. The contacting means as set forth in claim 1, comprising a pin-like configuration of the first contact element.

7. The contacting means as set forth in claim 1, adapted in design for the simultaneous electrical contacting of a plurality of valve drives, the support housing having a plurality of juxtaposed contacting areas, which are respectively provided for making contact between one valve drive and the printed circuit board, and which respectively comprise at least one through duct fitted with a resiliently elastic contacting unit.

8. The contacting means as set forth in claim 7, wherein the housing is divided up into a plurality of support housing segments respectively defining at least one contacting area.

9. The contacting means as set forth in claim 1, wherein in the respective through ducts of the support housing abutment means are provided, which at least toward the valve drive side form a movement checking abutment for the associated contacting unit.

10. The contacting means as set forth in claim 9, wherein the opening on the printed circuit board side of the respective through duct forms an assembly opening, through which the associated contacting unit may be inserted into the through duct.

11. The contacting means as set forth in claim 9, wherein the abutment means constitute a seal seat, against which the contacting unit rests with a spring loading bias when the valve drive is not contacted.

12. The contacting means as set forth in claim 1, wherein at least one contacting unit includes a compression spring, which at one end may bear on a contact face of the printed circuit board and on which at the other end a contacting body is arranged for acting upon by the intermediary of a first contact element of the connection part of the valve drive to be contacted.

13. The contacting means as set forth in claim 12, wherein the contacting body is spherical in form.

14. The contacting means as set forth in claim 12, wherein the compression spring is adapted for directly bearing against the contact face of the second contact element provided on the printed circuit board.

15. The contacting means as set forth in claim 12, wherein the compression spring functions as an electrical conductor of the contacting unit.

16. A valve arrangement comprising at least one valve, which is associated with at least one electrical valve drive which by means of first contact elements provided on a connection part is electrically connected with second contact elements provided on a printed circuit board and furthermore comprising a contacting means, which possesses a support housing arranged between the connection part and the printed circuit board, such support housing having for the respective electrical connection to be produced, a contacting unit arranged in the through duct and being resiliently elastic in the longitudinal direction of the duct, such contacting unit being acted upon at one end by a contact face of a first contact element and at the other end by a contact face a second contact element of the printed circuit board and owing to the compression resulting from being acted upon engages the two contact faces with a spring biasing action.

17. The valve arrangement as set forth in claim 16, having a configuration of the contacting means as set forth in claim 1.

* * * * *